US005548870A

United States Patent [19]

Grass, sen.

[11] Patent Number: 5,548,870

[45] Date of Patent: Aug. 27, 1996

[54] HINGE CUP WITH RELEASABLE FASTENER IN A CABINET COMPONENT

[75] Inventor: Alfred Grass, sen., Höchst/Vlbg., Austria

[73] Assignee: Grass AG, Hochst/Vlbg, Austria

[21] Appl. No.: 241,279

[22] Filed: May 11, 1994

[30] Foreign Application Priority Data

May 12, 1993 [DE] Germany ..... 93 07 211.2

[51] Int. Cl.[6] ..... E05D 7/10

[52] U.S. Cl. ..... 16/254; 16/272; 16/382

[58] Field of Search ..... 16/254, 272, 382, 16/383, 384, DIG. 43, 261, 387

[56] References Cited

U.S. PATENT DOCUMENTS

| | | | |
|---|---|---|---|
| 4,270,240 | 6/1981 | Zernig et al. | 16/383 |
| 5,195,214 | 3/1993 | Lautenschlager et al. | 16/382 |
| 5,239,730 | 8/1993 | Grass | 16/272 |
| 5,283,929 | 2/1994 | Lin | 16/237 |
| 5,345,654 | 9/1994 | Ferrari et al. | 16/272 |
| 5,347,687 | 9/1994 | Lautenschlager | 16/382 |
| 5,388,309 | 2/1995 | Grass | 16/272 |

FOREIGN PATENT DOCUMENTS

| | | | |
|---|---|---|---|
| 2162968 | 6/1973 | Germany | 16/383 |

*Primary Examiner*—Chuck Y. Mah
*Attorney, Agent, or Firm*—Petree Stockton, LLP

[57] ABSTRACT

A hinge cup with releasable fastener for use with a cabinet component having a bore hole includes an assembly component anchorable in the cabinet component bore hole. The assembly component is provided with a receptacle, and a cup casing is receivable in the assembly component receptacle in a press fit relationship and is fastenable to the assembly component.

6 Claims, 1 Drawing Sheet

HINGE CUP WITH RELEASABLE FASTENER IN A CABINET COMPONENT

BACKGROUND OF THE INVENTION

1. Field of the Invention

Figures 1, 2, 3:
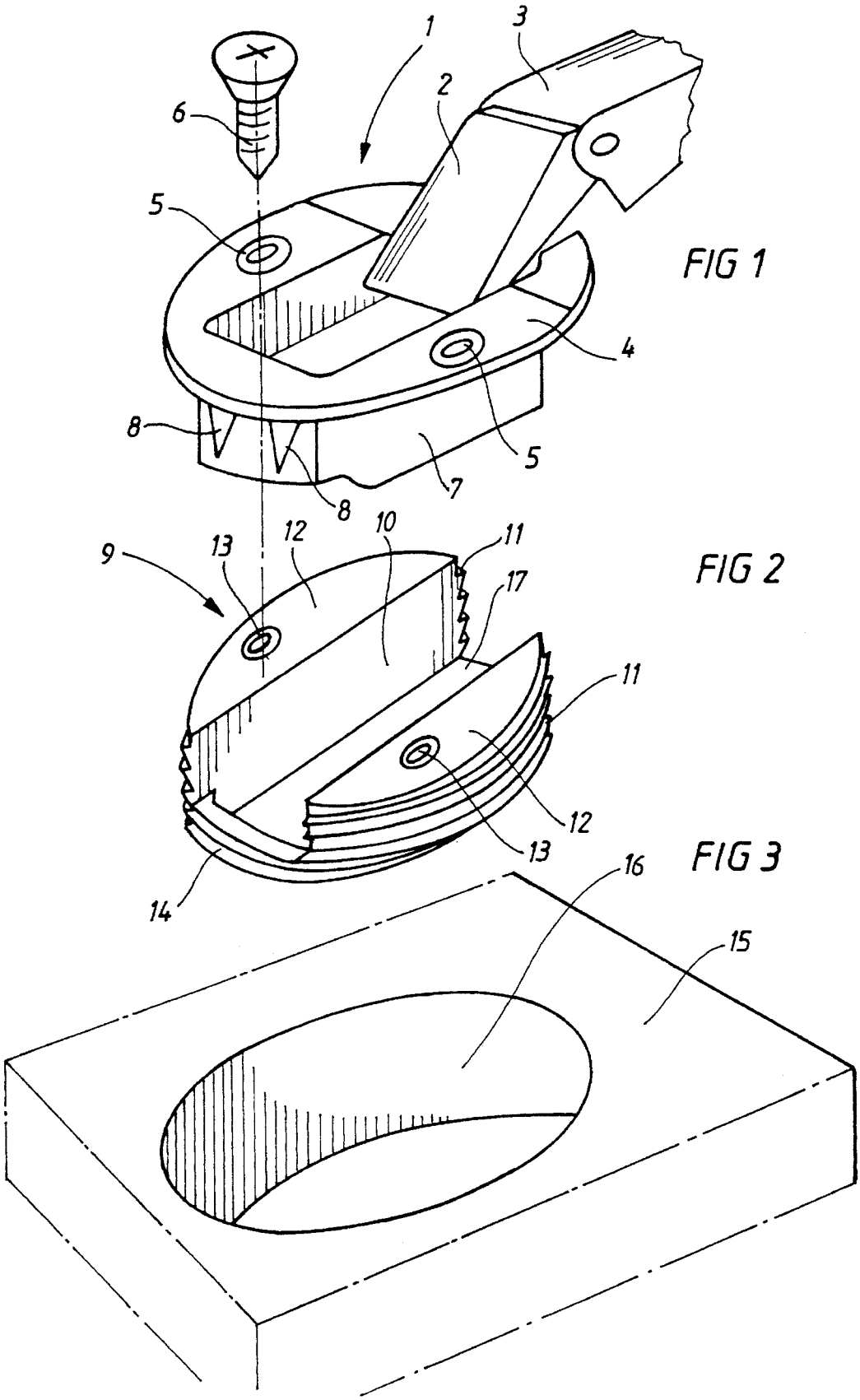

The innovation concerns a hinge cup with releasable fastener in a cabinet component, and more particularly a hinge cup having an assembly component anchorable in the bore hole of a cabinet component and a cup casing fastenable to the assembly component.

2. Description of the Prior Art

Similar types of hinge cups have been made known with previous registered patent applications from the same aforementioned applicants. Therein, a cup-like assembly component is anchored in the receptacle bore hole of the cabinet component and the releasable connection between the hinge cup and the assembly component consists of a bayonette-type rotating joint which is known as the "Twist Lock" fastener.

A hinge cup with releasable fastener of this type has already proven itself. On the one hand, nevertheless, a simpler anchoring of the hinge cup in the assembly component and simplification of the fastening of the assembly component in the cabinet component's receptacle bore hole can be aspired.

The purpose of the innovation is to simplify and develop the above-mentioned connection.

SUMMARY OF THE INVENTION

The innovation's fundamental and significant feature is that the assembly component is formed as a somewhat cylinder shaped, ribbed plastic component which is delivered with the hinge cup as a premounted component. The cabinet/furniture company receives the hinge cup with the attached position security on the fastened assembly part for the purpose of mounting the hinge cup. The cabinet/furniture company presses the combination metal—plastic cup in the receptacle bore hole in the cabinet component (especially in the door).

The cup-type assembly component then holds by itself by the press fit. Should the hinge cup (for example, because of a defect in the joint mechanism) be exchanged, it is sufficient that the screws, which engage through the screw-down plate of the hinge cup in the assembly component, are screwed out so that the hinge cup can be pulled out of the receptacle bore hole of the remaining assembly component.

A new hinge can then be placed in the slot-shaped receptacle of the assembly component and a new hinge cup can be fastened on the assembly component with the help of the screw-down plate.

The resulting advantage is that, on the one hand, there is a simpler connection between the hinge cup and the cup-shaped assembly component and, on the other hand, the assembly component can be fastened in the receptacle bore hole of the cabinet component in a simpler method, namely, by press fit.

Hereby, it is preferred that barbed-like projections (ribs) are placed on the outer circumference of the cup-shaped assembly component, which guarantee a secure press fit of the assembly component in the receptacle bore hole.

Also included in the inventive concept of the submitted innovation are additional anchoring methods, such as spreadable brace tabs, radial spreadable prongs, barbs and similar devices.

The advantage achieved with the submitted technical solution is that the screw-down plate of the hinge cup no longer is directly fastened to the cabinet component itself, but instead, the screws, which engage back through the screw-down plate, engage in the corresponding bore holes of the assembly component. The cabinet component, itself, is no longer weakened by the corresponding bore holes, and there is no longer the danger that these bore holes can be ripped out of the cabinet component because the corresponding fastening bore holes are placed themselves in the assembly component. Moreover, there is the advantage that the cost of assembly is less, because now only a single round receptacle bore hole must be placed in the cabinet component.

The inventive basis of the submitted innovation results from not only the matter of the individual claims, but also the various combinations of the individual claims.

All records, documents and evidence, inclusive of the summary, open and disclosed statements, declarations, indications and features, especially those represented embodiments in the drawings, will be claimed as fundamental and significant to the invention, as far as the claims, individually or in combinations, are relative to the position that the technology is new.

The innovation on hand will be explained more precisely in the following embodiments in the represented drawings. Hereby, additional significant and fundamental features and advantages follow from the drawings and their descriptions.

BRIEF DESCRIPTION OF THE INVENTION

FIG. 1: Perspective of a side view of a hinge cup;

FIG. 2: Perspective embodiment of an assembly component;

FIG. 3: Perspective embodiment of the receptacle bore hole in the cabinet component.

The hinge cup (1), itself, consists of a known method with one or more articulated levers (2) connected, on the one hand, swiveling with a hinge arm (3), and, on the other hand, self-swiveling with the hinge cup (1).

A screw-down plate (4) is placed on the upper side of the cup casing (7), which has one or more bore holes (5) through which screws (6) engage.

The hinge cup (1) corresponds to an assembly component (9) which preferably consists of a plastic component which has two bodies (12), which are mirror symmetrical to the transverse or lengthwise center axis of assembly component (9). A somewhat slot-shaped receptacle (10) is defined in the center of assembly component (9) between the two bodies (12).

Both bodies (12) are connected together by a shared bottom plate (17). A front wall (14) can also be provided to further connect the bodies (12). The front wall (14) extends upward from the bottom plate (17) on one side of assembly component (9) and joins the side walls of the bodies (12). The outer circumference of the assembly component (9) can be formed cylinder-shaped, but can also be formed elliptical, oval or polygonal.

The outer circumference of the assembly component (9) is preferably provided with barbed-shaped ribs (11), so that the assembly component (9) can be press fitted in a corresponding receptacle bore hole (16) in a cabinet component (15).

Simultaneously, the cup casing (7) engages substantially form-fitting in the corresponding receptacle (10) in the assembly component (9); whereby, the side walls and front walls of the cup casing (7) lie form-fitting against the corresponding side walls and front walls in the receptacle (10) area in a press fit relationship. This results in a functional, practical clearance-free fit of the hinge cup (1) in the assembly component (9).

The prongs (8) can be provided on the screw-down plate (4) for further security of position when assembly component (9) is press fitted in receptacle bore hole (16) of cabinet component (15) and hinge cup (1) is in turn engaged in assembly component (9), it follows directly that prongs (8) positioned on screw-down plate (4) of hinge cup (1), as shown in FIG. 1, engage in cabinet component (15) to provide such further security of position.

This type of position security serves to improve the hold between the hinge cup (1) and the assembly component (9) when both components are not yet fastened in the receptacle bore hole (16).

It is important to have the bore holes (13) in the area of the bodies (12) to engage the screws (6), so that the screws (6) are not screwed in the corresponding bore holes in the cabinet component (15), but instead are screwed in the bore holes (13) of the assembly component (9).

I claim:

1. A hinge cup with releasable fastener for use with a cabinet component provided with a bore hole, comprising:

an assembly component receivable in the bore hole of the cabinet component, the assembly component including means for anchoring the assembly component in the bore hole of the cabinet component, the assembly component having portions defining a receptacle, and at least one bore hole formed in the assembly component for receiving a fastener;

a cup casing receivable in the receptacle of the assembly component and having an upper portion provided with a screw-down plate, and at least one bore hole formed in the screw-down plate, corresponding to the at least one bore hole of the assembly component, for receiving the fastener through the bore hole of the screw-down plate and into the at least one bore hole of the assembly component;

said assembly component having a transverse axis lying in a transverse plane of substantial symmetry of the assembly component, the assembly component having a front wall and a bottom plate and having two opposing body portions, each of the body portions including a side wall, and said receptacle of the assembly component is defined at least in part by the side walls of the opposing body portions of the assembly component, the front wall of the assembly component, and the bottom plate of the assembly component; and at least one prong extending from said screw-down plate of said cup casing for engaging said cabinet component.

2. The hinge cup as claimed in claim 1, wherein said assembly component is made of plastic material.

3. The hinge cup as claimed in claim 1, wherein said cup casing is receivable in said receptacle of said assembly component in a press fit relationship.

4. The hinge cup as claimed in claim 1, further comprising a second prong extending from said screw-down plate of said cup casing for engaging said cabinet component.

5. The hinge cup as claimed in claim 1, wherein said two opposing body portions of said assembly component are arranged symmetrically relative to one another, and the two opposing body portions of the assembly component are each connected to said bottom plate of the assembly component.

6. The hinge cup as claimed in claim 1, wherein said fastener is a fastening screw.

* * * * *